US010431376B2

(12) United States Patent
Kawai

(10) Patent No.: US 10,431,376 B2
(45) Date of Patent: Oct. 1, 2019

(54) IGNITION COIL FOR INTERNAL COMBUSTION ENGINE

(71) Applicant: DENSO CORPORATION, Kariya, Aichi-pref. (JP)

(72) Inventor: Kazuhide Kawai, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 15/760,308

(22) PCT Filed: Sep. 1, 2016

(86) PCT No.: PCT/JP2016/075613
§ 371 (c)(1),
(2) Date: Mar. 15, 2018

(87) PCT Pub. No.: WO2017/047390
PCT Pub. Date: Mar. 23, 2017

(65) Prior Publication Data

US 2018/0254144 A1 Sep. 6, 2018

(30) Foreign Application Priority Data

Sep. 16, 2015 (JP) ..... 2015-183380

(51) Int. Cl.
*H01F 38/12* (2006.01)
*F02P 15/00* (2006.01)
(Continued)

(52) U.S. Cl.
CPC ..... *H01F 38/12* (2013.01); *F02P 15/00* (2013.01); *H01F 27/04* (2013.01); *H01F 27/40* (2013.01); *F02P 3/02* (2013.01); *F02P 13/00* (2013.01)

(58) Field of Classification Search
CPC ..... F02P 15/00; H01F 27/04; H01F 27/40; H01F 38/12
(Continued)

(56) References Cited

U.S. PATENT DOCUMENTS 5,729,505 A * 3/1998 Murata ..... F02P 3/02 123/634
7,701,318 B2 * 4/2010 Ayusawa ..... F02P 1/005 336/192
(Continued)

FOREIGN PATENT DOCUMENTS

CN 201092926 7/2008
JP H05-175058 7/1993
(Continued)

*Primary Examiner* — John Kwon
*Assistant Examiner* — Johnny H Hoang
(74) *Attorney, Agent, or Firm* — Nixon & Vanderhye P.C.

(57) ABSTRACT

An ignition coil for an internal combustion engine according to the present embodiment includes a primary coil, a secondary coil, a center core, an outer circumferential core, an igniter, a case, a connector unit, and a relay member. The relay member electrically connects the outer circumferential core and a grounding terminal member. The relay member includes: a base portion provided along the rear surface of an engagement wall; a standing portion standing rearward of the base portion; and a curved portion that extends from a rear end of the standing portion in a vertical direction Z orthogonal to a coil axis direction X and is curved to protrude rearward. The base portion is in contact with an inner grounding terminal at one end in the vertical direction Z. The standing portion is provided further outward than the igniter in a horizontal direction Y. The curved portion is elastically deformed and is urged against a front surface of the outer circumferential core.

9 Claims, 12 Drawing Sheets

(51) Int. Cl.

| | |
|---|---|
| ***H01F 27/04*** | (2006.01) |
| ***H01F 27/40*** | (2006.01) |
| *F02P 3/02* | (2006.01) |
| *F02P 13/00* | (2006.01) |

(58) Field of Classification Search
USPC ..... 123/149 A, 149 D, 149 F, 634, 635; 336/192, 199, 205–209
See application file for complete search history.

(56) References Cited

U.S. PATENT DOCUMENTS

| | | | | |
|---|---|---|---|---|
| 8,922,314 | B2 * | 12/2014 | Kobayashi | H01F 38/12 336/110 |
| 9,548,156 | B2 * | 1/2017 | Kawai | H01F 38/12 |
| 2007/0246029 | A1 | 10/2007 | Ayusawa | |

FOREIGN PATENT DOCUMENTS

| | | |
|---|---|---|
| JP | 2003-197446 | 7/2003 |
| JP | 2005-340419 | 12/2005 |
| JP | 2007-180295 | 7/2007 |
| JP | 2007-198193 | 8/2007 |
| JP | 2009-188364 | 8/2009 |
| JP | 2009-266906 | 11/2009 |
| JP | 2009-299614 | 12/2009 |
| JP | 2010-182842 | 8/2010 |
| JP | 2013-115074 | 6/2013 |
| JP | 2013-115075 | 6/2013 |
| JP | 2013-115076 | 6/2013 |
| JP | 2013-115296 | 6/2013 |
| JP | 2013-115397 | 6/2013 |
| KR | 10-1386105 | 4/2014 |

* cited by examiner

IGNITION COIL FOR INTERNAL COMBUSTION ENGINE

This application is the U.S. national phase of International Application No. PCT/JP2016/075613 filed Sep. 1, 2016, which designated the U.S. and claims priority to JP Patent Application No. 2015-183380 filed Sep. 16, 2015, the entire contents of each of which are hereby incorporated by reference.

TECHNICAL FIELD

The present invention relates to an ignition coil for an internal combustion engine.

BACKGROUND ART

As an ignition coil for an internal combustion engine, there is an ignition coil which includes: a primary coil; a secondary coil; a center core disposed on an inner circumference side of the primary coil and the secondary coil; an outer circumferential core disposed on an outer circumference side of the primary coil and the secondary coil; and an igniter that allows and blocks electrical conduction through the primary coil (for example, refer to Patent Literature 1). The primary coil, the secondary coil, the center core, the outer circumferential core, and the igniter are housed within a case. A connector unit which is connected to external devices is formed projecting from the case. The connector unit includes a signal terminal member for transmitting a switching signal to the igniter and a grounding terminal member for grounding the igniter, for example.

In the above-mentioned ignition coil, the above-mentioned outer circumferential core is connected to the grounding terminal member of the connector unit via a conductive member. Thus, the outer circumferential core can be grounded (earthed). When the outer circumferential core is grounded, for example, noise generated from the outer circumferential core can be prevented from occurring.

Particularly, in recent environment friendly engines, the output voltage of the ignition coil has been increased. Accordingly, the charged voltage of the center core and the outer circumferential core has been increased. Thus, in order to reduce the influence of the charged voltage of the center core and the outer circumferential core on the igniter, it is further desired that an ignition coil with a built-in igniter be configured to allow the outer circumferential core to have a ground potential. In addition, it is desirable that the center core and the outer circumferential core be allowed to have a ground potential easily at low cost.

CITATION LIST

Patent Literature

[PTL 1] JP 2009-299614 A

SUMMARY OF THE INVENTION

Technical Problem

However, in the above-mentioned ignition coil, since the conductive member is welded at both ends to the grounding terminal member and a terminal extending from the outer circumferential core, it is difficult to improve manufacturing efficiency. Specifically, since both ends of the conductive member are welded, etc., to the grounding terminal member and the terminal extending from the outer circumferential core, precise positioning of the conductive member with the grounding terminal member and the outer circumferential core is required. Therefore, there is difficulty in connecting the conductive member with the grounding terminal member and the outer circumferential core, leading to difficulty in improving the manufacturing efficiency of the ignition coil.

Furthermore, the signal terminal member, the grounding terminal member, etc., provided in the connector unit, and electronic components and terminals thereof connected to the signal terminal member, the grounding terminal member, etc., are densely spaced in the region in which the conductive member is provided. Therefore, work space for connecting the conductive member with the grounding terminal member and the terminal extending from the outer circumferential core is likely to be small, and since these are welded in such small work space, the difficulty in improving the manufacturing efficiency increases.

The present invention has been made in view of the above problem and aims to provide an ignition coil for an internal combustion engine which can improve the manufacturing efficiency by facilitating grounding of an outer circumferential core.

Solution to Problem

One aspect of the present invention is an ignition coil for an internal combustion engine which includes: a primary coil wound around a primary spool; a secondary coil wound around a secondary spool provided on an outer circumference side of the primary coil; a center core disposed on an inner circumference side of the primary coil and the secondary coil; an outer circumferential core disposed on the outer circumference side of the primary coil and the secondary coil; an igniter provided on a front side of the center core in a coil axis direction which is a direction of an axis about which the primary coil and the secondary coil are wound; a case which houses the primary coil, the secondary coil, the center core, the outer circumferential core, and the igniter; a connector unit mounted on a front end of the case and including at least a signal terminal member for transmitting a switching signal to the igniter and a grounding terminal member for grounding the igniter; and a relay member that electrically connects the outer circumferential core and the grounding terminal member, wherein the connector unit includes an engagement wall that is engaged with the case and faces the igniter from the front of the igniter in the coil axis direction, the signal terminal member penetrates the engagement wall and includes an inner signal terminal projecting into the case, the grounding terminal member penetrates the engagement wall and includes an inner grounding terminal projecting into the case, the relay member includes a base portion provided along a rear surface of the engagement wall, a standing portion standing rearward of the base portion, and a curved portion that extends from a rear end of the standing portion in a vertical direction orthogonal to the coil axis direction and is curved to protrude rearward, the base portion is in contact with the inner grounding terminal at one end in the vertical direction, the standing portion is provided further outward than the igniter in a horizontal direction orthogonal to both the coil axis direction and the vertical direction, and the curved portion is elastically deformed and is urged against a front surface of the outer circumferential core.

Advantageous Effects of the Invention

In the above-mentioned ignition coil for an internal combustion engine, the curved portion is elastically deformed and is urged against the front surface of the above-mentioned outer circumferential core. Therefore, the relay member and the outer circumferential core can be connected by bringing the curved portion of the relay member into contact with any part of the front surface of the outer circumferential core. Accordingly, even when the positional relationship between the relay member and the outer circumferential core is not precisely determined, the relay member and the outer circumferential core can be connected. Thus, the manufacturing efficiency of the ignition coil improves.

Furthermore, the relay member has the base portion in contact with the inner grounding terminal and has the curved portion elastically deformed in urged against the front surface of the outer circumferential core. Therefore, the relay member can be connected to the inner grounding terminal and the outer circumferential core without welding. Thus, the task of mounting these is facilitated, improving the manufacturing efficiency of the ignition coil.

Furthermore, the base portion is provided along the rear surface of the engagement wall, and the standing portion is provided further outward than the igniter in the horizontal direction. Therefore, the igniter and the relay member can be prevented from interfering with each other when the igniter is disposed on the front side of the center core. Thus, the manufacturing efficiency of the ignition coil improves.

As described above, an ignition coil for an internal combustion engine which can improve manufacturing efficiency can be provided according to the above-mentioned aspect.

DESCRIPTION OF THE EMBODIMENTS

First Embodiment

An embodiment of an ignition coil for an internal combustion engine will be described with reference to FIGS. 1 to 9.

Figure 1:
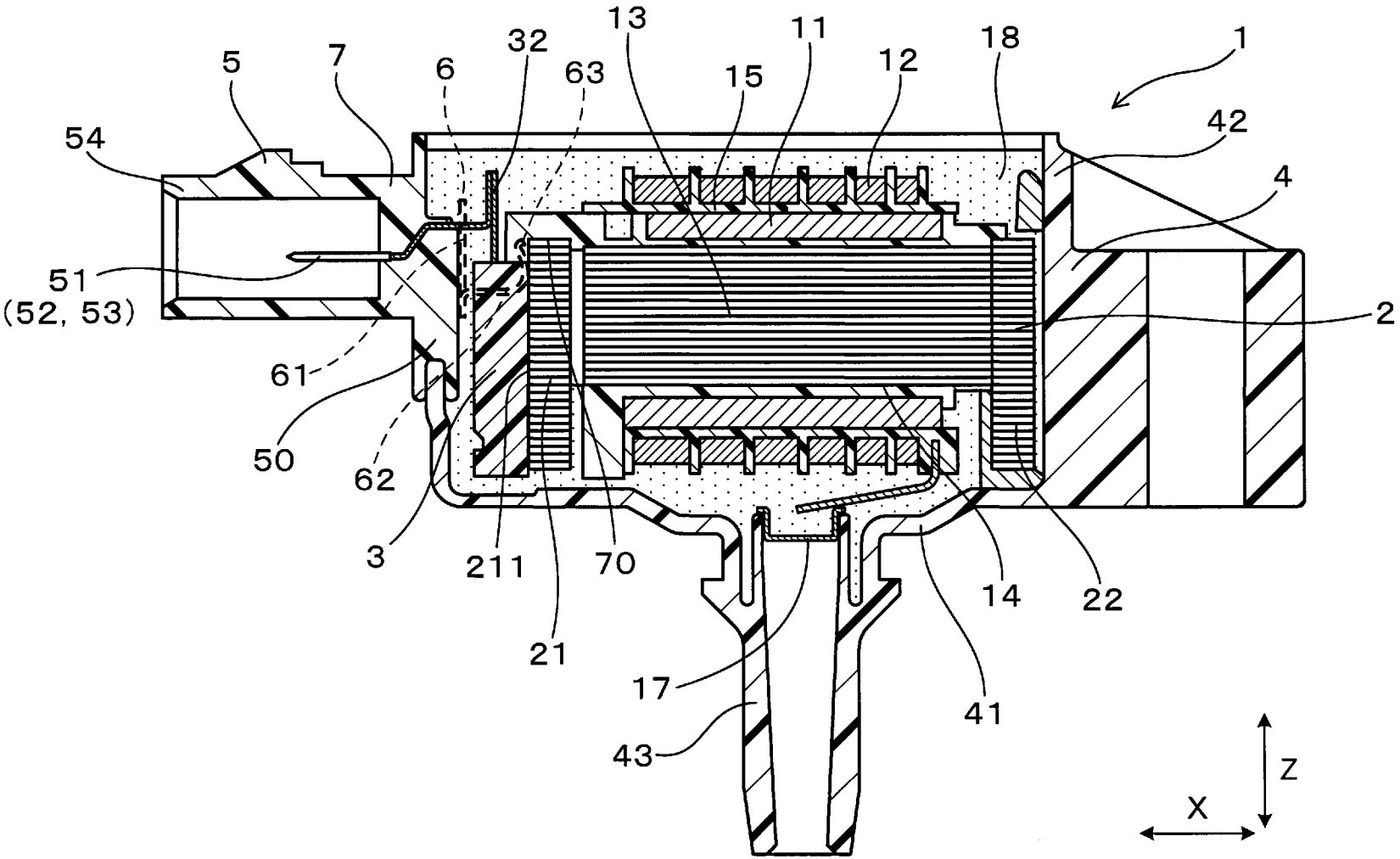
FIG. 1 is a cross-sectional view of an ignition coil for an internal combustion engine according to a first embodiment.

As shown in FIG. 1, an ignition coil for an internal combustion engine according to the present embodiment includes a primary coil 11, a secondary coil 12, a center core 13, an outer circumferential core 2, an igniter 3, a case 4, a connector unit 5, and a relay member 6. The primary coil 11 is wound around a primary spool 14. The secondary coil 12 is wound around a secondary spool 15 provided on an outer circumference side of the primary coil 11. The center core 13 is disposed on an inner circumference side of the primary coil 11 and the secondary coil 12. The outer circumferential core 2 is disposed on the outer circumference side of the primary coil 11 and the secondary coil 12.

Figure 4:
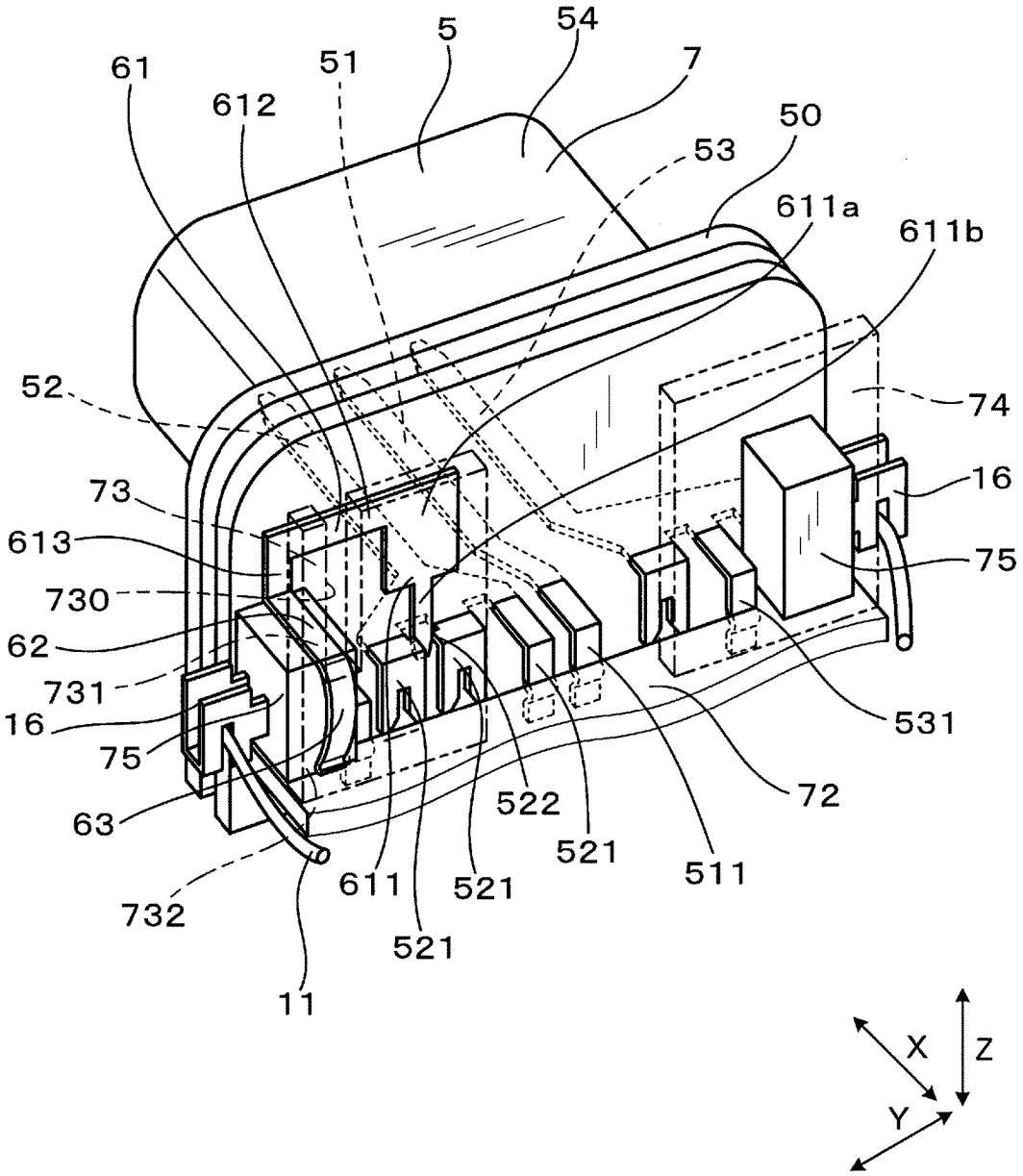
FIG. 4 is a partial enlarged perspective view of the connector module and a relay member according to the first embodiment.

The igniter 3 is provided on a front side (on the left side in FIG. 1) of the center core 13 in a coil axis direction X which is a direction of an axis about which the primary coil 11 and the secondary coil 12 are wound. The case 4 houses the primary coil 11, the secondary coil 12, the center core 13, the outer circumferential core 2, and the igniter 3. As shown in FIG. 4, the connector unit 5 includes at least a signal terminal member 51 for transmitting a switching signal to the igniter 3, and a grounding terminal member 52 for grounding the igniter 3. Further, as shown in FIG. 1, the connector unit 5 is mounted on a front end of the case 4 (on the left side in FIG. 1).

Figure 5:
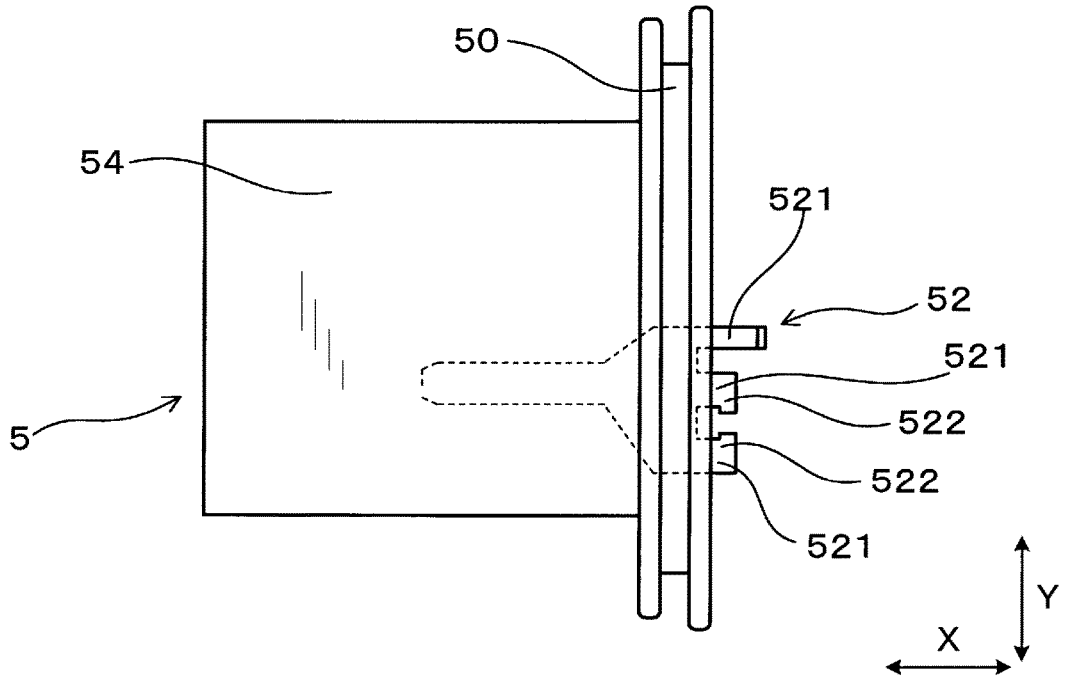
FIG. 5 is an illustration of a connector unit according to the first embodiment as seen from a leading end.

The relay member 6 electrically connects the outer circumferential core 2 and the grounding terminal member 52. As shown in FIGS. 1 and 5, the connector unit 5 includes an engagement wall 50 that is engaged with the case 4 and faces the igniter 3 from a front of the igniter 3 in the coil axis direction X. As shown in FIG. 4, the signal terminal member 51 penetrates the engagement wall 50 and includes an inner signal terminal 511 projecting into the case 4. The grounding terminal member 52 penetrates the engagement wall 50 and includes an inner grounding terminal 521 projecting into the case 4.

Figure 2:
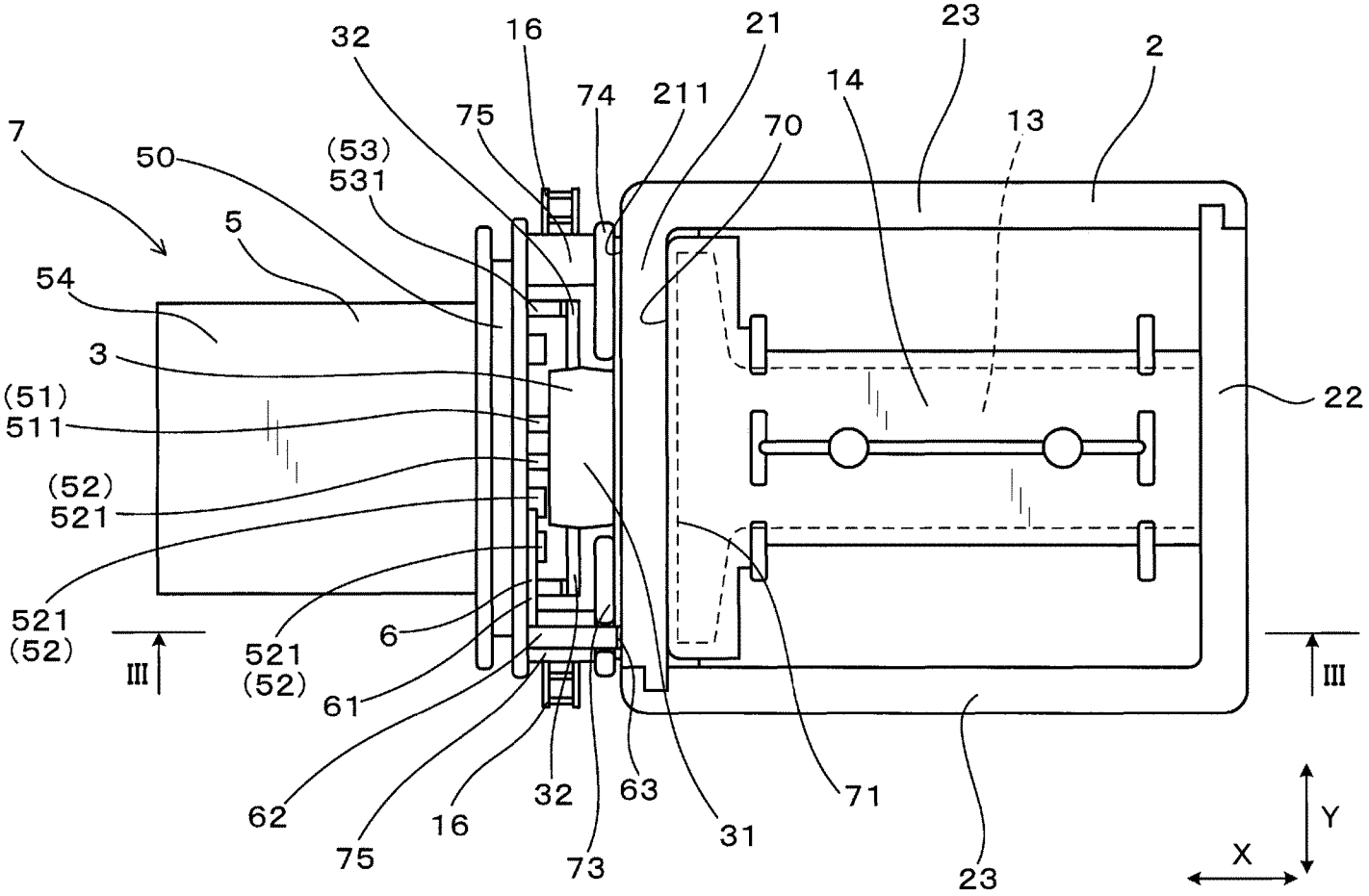
FIG. 2 is an illustration of a connector module, a center core, an outer circumferential core, and an igniter according to the first embodiment as seen from a leading end.
Figure 3:
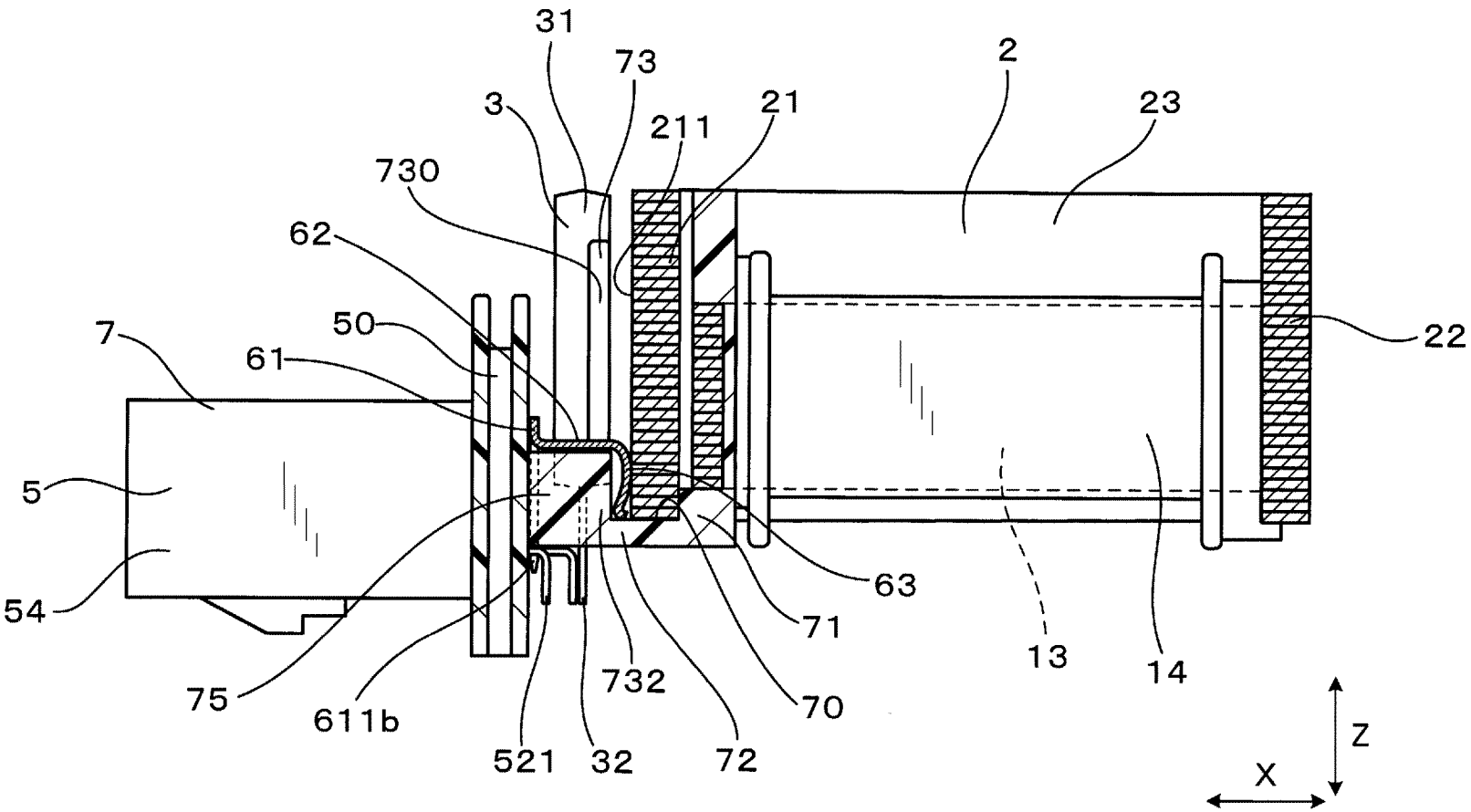
FIG. 3 is a cross-sectional view taken along line in FIG. 2 as seen in an arrow direction.

As shown in FIGS. 3 and 4, the relay member 6 includes: a base portion 61 provided along the rear surface of the engagement wall 50; a standing portion 62 standing rearward of the base portion 61; and a curved portion 63 that extends from the rear end of the standing portion 62 in a vertical direction Z orthogonal to the coil axis direction X and is curved to protrude rearward. As shown in FIG. 4, the base portion 61 is in contact with the inner grounding terminal 521 at one end in the vertical direction Z. As shown in FIG. 2, the standing portion 62 is provided further outward than the igniter 3 in a horizontal direction Y orthogonal to both the coil axis direction X and the vertical direction Z. As shown in FIGS. 1 and 3, the curved portion 63 is elastically deformed and is urged against a front surface 211 of the outer circumferential core 2.

The above-mentioned ignition coil 1 for the internal combustion engine is, for example, connected to a spark plug (not shown in the drawings) grounded on an automobile, an internal combustion engine such as a cogeneration, or the like, and is used as a means for applying high voltage to the spark plug.

In the description, one coil axis direction X (the left side in FIG. 1) is referred to as front, and an opposite direction is referred to as rear. Likewise, one vertical direction Z (the bottom side in FIG. 1) is referred to as toward a leading end, and an opposite direction is referred to as toward a trailing end.

As shown in FIG. 1, the primary coil 11 and the secondary coil 12 are concentrically disposed overlapping as inner and outer circumferences. The primary spool 14 around which the primary coil 11 is wound and the secondary spool 15 around which the secondary coil 12 is wound are made of plastic.

The center core 13 provided inside the primary coil 11 and the secondary coil 12 and the outer circumferential core 2 provided outside the primary coil 11 and the secondary coil 12 are formed by stacking pressed and punched magnetic steel sheets. The magnetic steel sheets forming the center core 13 and the outer circumferential core 2 are stacked in a thickness direction in a state where a thickness direction is the vertical direction Z. Both end surfaces in a stacking direction (the vertical direction Z) of each of the magnetic steel sheets forming the center core 13 and the outer circumferential core 2 are coated by an insulating material not shown in the drawings. Meanwhile, each of the magnetic steel sheets forming the center core 13 and the outer circumferential core 2 has an edge located in a direction orthogonal to the stacking direction that is exposed from the insulating material. The curved portion 63 of the relay member 6 abuts the front surface 211 of the outer circumferential core 2, at least in a part of the portion of the magnetic steel sheet exposed from the insulating material, allowing electrical conduction between the outer circumferential core 2 and the relay member 6.

The plurality of stacked magnetic steel sheets are integrally fixed to each other to form the center core 13 and the outer circumferential core 2. As a method of integrating the plurality of stacked magnetic steel sheets, there is a method of fastening the plurality of stacked magnetic steel sheets in the vertical direction Z with rivets, for example. Aside from this, there is also what is called a dowel crimping method in which a dowel projecting on one side in vertical direction Z is formed on each of the magnetic steel sheets by stamping or the like and the plurality of stacked magnetic metal sheets are fixed by fitting the dowel on each of the magnetic steel sheets into a recess in the back of the dowel on another magnetic steel sheet adjacent thereto in the vertical direction Z. Alternatively, the plurality of stacked magnetic steel sheets may be fixed by welding. The plurality of stacked magnetic steel sheets are electrically connected to the magnetic steel sheet adjacent thereto in the vertical direction Z.

As shown in FIG. 2, the center core 13 takes the form of a substantially rectangular column elongated in the coil axis direction X. The outer circumferential core 2 includes a front-facing side portion 21 that faces the center core 13 from the front and a rear-facing side portion 22 that faces the center core 13 from the rear. Furthermore, the outer circumferential core 2 includes a pair of connection side portions 23 that are formed along the coil axis direction X and connect the ends of the front-facing side portion 21 and the rear-facing side portion 22 to each other. In other words, the outer circumferential core 2 takes the form of a substantially rectangular frame.

As shown in FIGS. 1 and 2, the igniter 3 is disposed in front of the front-facing side portion 21 so as to face the front end surface of the front-facing side portion 21. The igniter 3 allows and blocks electrical conduction through the primary coil 11. The igniter 3 includes a plurality of igniter terminals 32 projecting from a body portion 31 toward the trailing end.

As shown in FIG. 1, components of the ignition coil 1 such as the primary coil 11, the secondary coil 12, the center core 13, the outer circumferential core 2, and the igniter 3 are housed in the case 4. The case 4 includes: a bottom wall portion 41 formed in a plane orthogonal to the vertical direction Z; and a side wall portion 42 standing from the edge of the bottom wall portion 41 toward the trailing end. The case 4 is open toward the trailing end.

As shown in FIGS. 1 to 5, the engagement wall 50 of the connector unit 5 is engaged with the side wall portion 42 in front of the igniter 3. The engagement wall 50 of the connector unit 5 has, on the edge, a groove for engaging the side wall portion 42 of the case 4. The connector unit 5 includes a tubular protrusion 54 formed projecting forward from the engagement wall 50.

As shown in FIG. 4, the connector unit 5 includes the signal terminal member 51 and the grounding terminal member 52, both penetrate the engagement wall 50 in the coil axis direction X. Furthermore, the connector unit 5 includes a power supply terminal member 53 that penetrates the engagement wall 50 in the coil axis direction X. The power supply terminal member 53 connects an external power supply and the primary coil 11. The power supply terminal member 53 includes an inner power supply terminal 531 in a part projecting into the case 4.

As shown in FIG. 2, each of the inner signal terminal 511, the inner grounding terminal 521, and the inner power supply terminal 531 is connected to a different igniter terminal 32

As shown in FIGS. 4 and 5, a rear end part of the grounding terminal member 52 is divided into three branches from a front part thereof in the horizontal direction Y. The branched parts of the grounding terminal member 52 project into the case 4. In other words, three inner grounding terminals 521 are arranged side by side in the horizontal direction Y.

As shown in FIGS. 1 to 3, the relay member 6 is provided between the engagement wall 50 of the connector unit 5 and the front-facing side portion 21 of the outer circumferential core 2 in the coil axis direction X. The relay member 6 is formed by, for example, bending a metal sheet.

Figure 6:
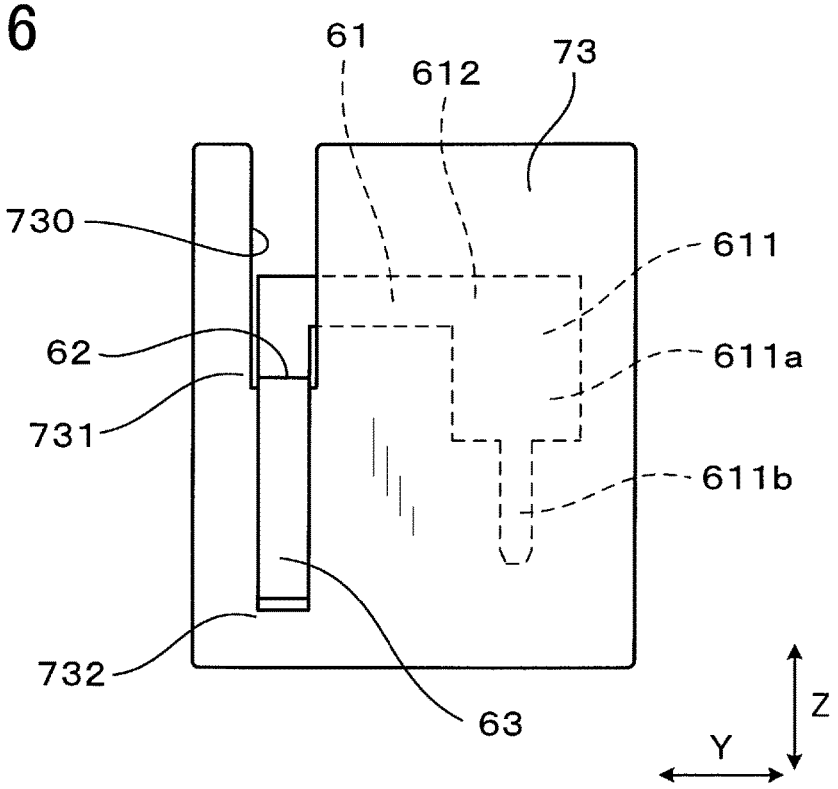
FIG. 6 is a front view of a third wall part and the relay member according to the first embodiment.

As shown in FIG. 4, the base portion 61 of the relay member 6 is disposed in such a way that the thickness direction thereof is the coil axis direction X. The base portion 61 has a front surface in abutment with the rear surface of the engagement wall 50. The base portion 61 includes: a first base portion 611 formed along the vertical direction Z; a second base portion 612 extending from a leading end of the first base portion 611 in the horizontal direction Y; and a third base portion 613 extending toward the trailing end from an end of the second base portion 612 opposite the first base portion 611. In other words, the shape of the base portion 61 viewed in the thickness direction takes the form of U open toward the trailing end. As shown in FIGS. 4 and 6, the first base portion 611 includes: a rectangular portion 611*a* in the form of a rectangle when viewed in the coil axis direction X; and an insertion fitting portion 611*b* projecting from the rectangular portion 611*a* toward the trailing end. The insertion fitting portion 611*b* extends toward the trailing end from the center of the rectangular portion 611*a* in the horizontal direction Y. The standing portion 62 projects from an end of the third base portion 613 opposite the second base portion 612.

As shown in FIG. 4, the insertion fitting portion 611*b*, which is a part of the base portion 61, is inserted and fitted between adjacent inner grounding terminals 521. Thus, the grounding terminal member 52 and the relay member 6 are electrically connected. The insertion fitting portion 611*b* is interposed between two inner grounding terminals 521 adjacent to each other in the horizontal direction Y among three inner grounding terminals 521. As shown in FIGS. 4 and 5, two inner grounding terminals 521 that hold the base portion 61 therebetween include facing portions 522 in parts behind the base portion 61 in the coil axis direction X. The facing portions 522 extend toward each other. As shown in FIG. 4, the leading edge of the facing portion 522 faces the rear surface of the base portion 61. Thus, the facing portion 522 prevents misalignment of the base portion 61 in the coil axis direction X. Note that as shown in FIG. 2, the inner grounding terminals 521 between which the base portion 61 is not inserted and fitted are connected to the igniter terminal 32 of the igniter 3.

As shown in FIG. 2, the standing portion 62 extends so as to pass outside the igniter 3 including the igniter terminal 32 when viewed in the horizontal direction Y. The standing portion 62 is positioned so that the thickness direction thereof is the vertical direction Z.

As shown in FIGS. 3, 4, and 6, the curved portion 63 extends toward the trailing end from an end of the standing portion 62 opposite the base portion 61. The curved portion 63 is positioned so that the thickness direction thereof is substantially the same as the coil axis direction X. As shown FIG. 3, the rear surface of the curved portion 63 having a curved cross-section orthogonal to the horizontal direction Y is urged against the front surface 211 of the front-facing side portion 21 of the outer circumferential core 2. Thus, the outer circumferential core 2 and the relay member 6 are electrically connected, and the outer circumferential core 2 and the grounding terminal member 52 are connected via the relay member 6.

As shown in FIG. 2, the primary spool 14 and the connector unit 5 are integrally formed to constitute a connector module 7. Note that FIG. 5 is an extracted illustration of only the connector unit 5 in the connector module 7 in which the illustrations of the signal terminal member and the power supply terminal member are omitted.

As shown in FIGS. 1 to 3, the connector module 7 includes, in a position along the front end surface of the center core 13 in front of the primary spool 14, a fitting recess 70 into which the front-facing side portion 21 of the outer circumferential core 2 is fitted. As shown in FIG. 3, the fitting recess 70 is open toward the leading end. As shown in FIGS. 2 and 3, the fitting recess 70 is formed of a first wall portion 71 facing the inner circumferential surface of the front-facing side portion 21; a second wall portion 72 facing the trailing end surface of the front-facing side portion 21; and a third wall portion 73 and a fourth wall portion 74 which face the outer circumferential surface of the front-facing side portion 21.

As shown in FIGS. 2 and 3, the first wall portion 71 is formed of a front end of the primary spool 14. The front surface 211 of the front-facing side portion 21 of the outer circumferential core 2 is in abutment with a leading end of the first wall portion 71. As shown in FIG. 3, the first wall portion 71 is open forward. The leading end surface of the center core 13 is exposed through the opening.

As shown in FIG. 2, the third wall portion 73 and the fourth wall portion 74 are formed on both sides of the igniter 3 in the horizontal direction Y. In other words, the igniter 3 is provided between the third wall portion 73 and the fourth wall portion 74 in the horizontal direction Y.

As shown in FIGS. 4 and 6, the connector module 7 includes a positioning portion 731 that positions the standing portion 62 of the relay member 62 from both ends in the horizontal direction Y. In the present embodiment, as shown in FIGS. 4 and 6, the third wall portion 73 has a slit portion 730 open toward the leading end. The standing portion 62 of the relay member 6 is disposed in the slit portion 730. The dimension of the slit portion 730 in the horizontal direction Y is substantially the same as the dimension of the standing portion 62 in the horizontal direction Y. Thus, the standing portion 62 is positioned in the horizontal direction Y. In other words, in the present embodiment, a part of the third wall portion 73 that is adjacent to the slit portion 730 in the horizontal direction Y constitutes the positioning portion 731.

As shown in FIGS. 3 and 4, the connector module 7 includes a supporting portion 732 that supports, from the front, an end of the curved portion 63 of the relay member 6 opposite the standing portion 62. In the present embodiment, the end of the curved portion 63 opposite the standing portion 62 is supported by the third wall portion 73, in abutment with a part of the third wall portion 73 that is on the trailing end of the slit portion 730. In other words, in the present embodiment, the part of the third wall portion 73 that is on the trailing end of the slit portion 730 constitutes the supporting portion 732.

As shown in FIG. 2, the connector module 7 includes a pair of connecting portions 75 which connect the connector unit 5 with the third wall portion 73 and the fourth wall portion 74. The pair of connecting portions 75 are formed from both ends in the horizontal direction Y of the rear surface of the engagement wall 50 of the connector unit 5 toward the third wall portion 73 and the fourth wall portion 74 along the coil axis direction X. As shown in FIGS. 2 to 4, the standing portion 62 of the relay member 6 is placed on the connecting portion 75 on the side connecting to the third wall portion 73. Thus, the relay member 6 is positioned in the vertical direction Z with respect to the connector module 7. Furthermore, wire connecting terminals 16 which connect the ends of the primary coil 11 are embedded in the pair of connecting portions 75. The pair of wire connecting terminals 16 project outward the connecting portions 75 in the horizontal direction Y. The standing portion 62 is provided inside the pair of the wire connecting terminals 16 in the horizontal direction Y.

As shown in FIG. 1, the bottom wall portion 41 of the case 4 includes a tubular high-pressure tower portion 43 passing therethrough in the vertical direction Z toward the leading end. A high-pressure output terminal 17 made of metal is fitted into a trailing end of the high-pressure tower portion 43. Thus, the trailing end of the high-pressure tower portion 43 is closed. Components of the ignition coil 1 such as the primary coil 11, the secondary coil 12, the center core 13, the outer circumferential core 2, and the igniter 3 are sealed with filler plastic 18 filled in a closed region inside the case 4.

Next, one example of a method for mounting the relay member 6 and the outer circumferential core 2 on the connector module 7 will be described with reference to FIGS. 7 to 9. In the present embodiment, the relay member 6 and the outer circumferential core 2 are mounted in this order on the connector module 7.

First, the way to mount the relay member 6 on the connector module 7 will be described.

Figure 7:
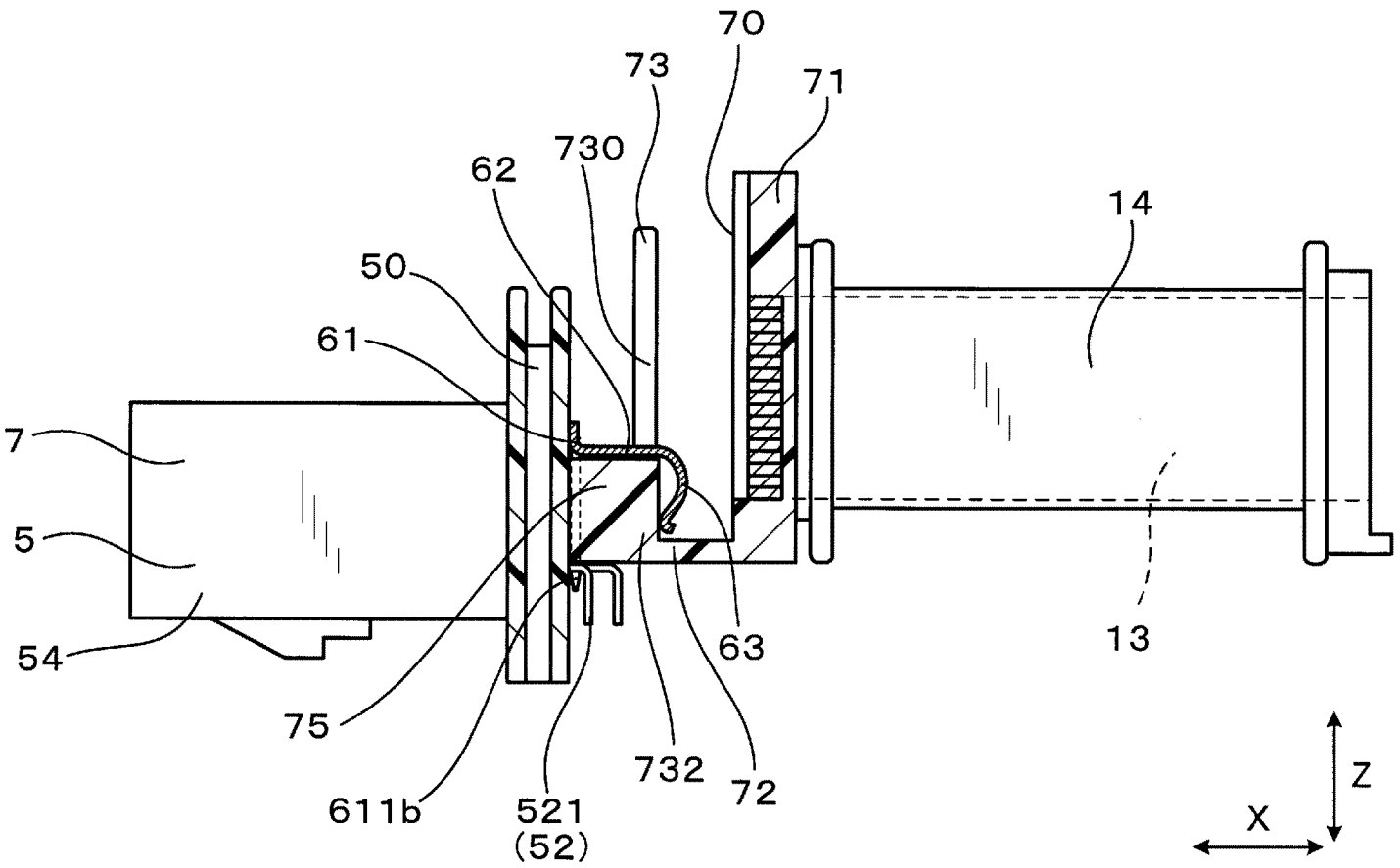
FIG. 7 is a drawing showing an appearance in which the relay member is mounted on the connector module according to the first embodiment.

As shown in FIG. 7, the relay member 6 is mounted on the connector module 7 from the leading end of the connector module 7. At this time, as shown in FIG. 6, the standing portion 62 is inserted into the slit portion 730 of the third wall portion 73. Thus, the relay member 6 is positioned in the horizontal direction Y with respect to the connector module 7. Subsequently, as shown in FIG. 7, the front surface of the base portion 61 is brought into abutment with the rear surface of the engagement wall 50. Thus, the relay member 6 is positioned in the coil axis direction X with respect to the connector module 7. In this state, the relay member 6 is moved toward the trailing end with respect to the connector module 7 so that the standing portion 62 is placed on the connecting portion 75. Thus, the relay member 6 is positioned in the vertical direction Z with respect to the connector module 7. Accordingly, as shown in FIG. 7, the relay member 6 can be mounted on the connector module 7 in the state of being positioned in all directions with respect to the connector module 7.

Next, the way to mount the outer circumferential core 2 on the connector module 7 having the relay member 6 mounted thereon will be described.

Figure 8:
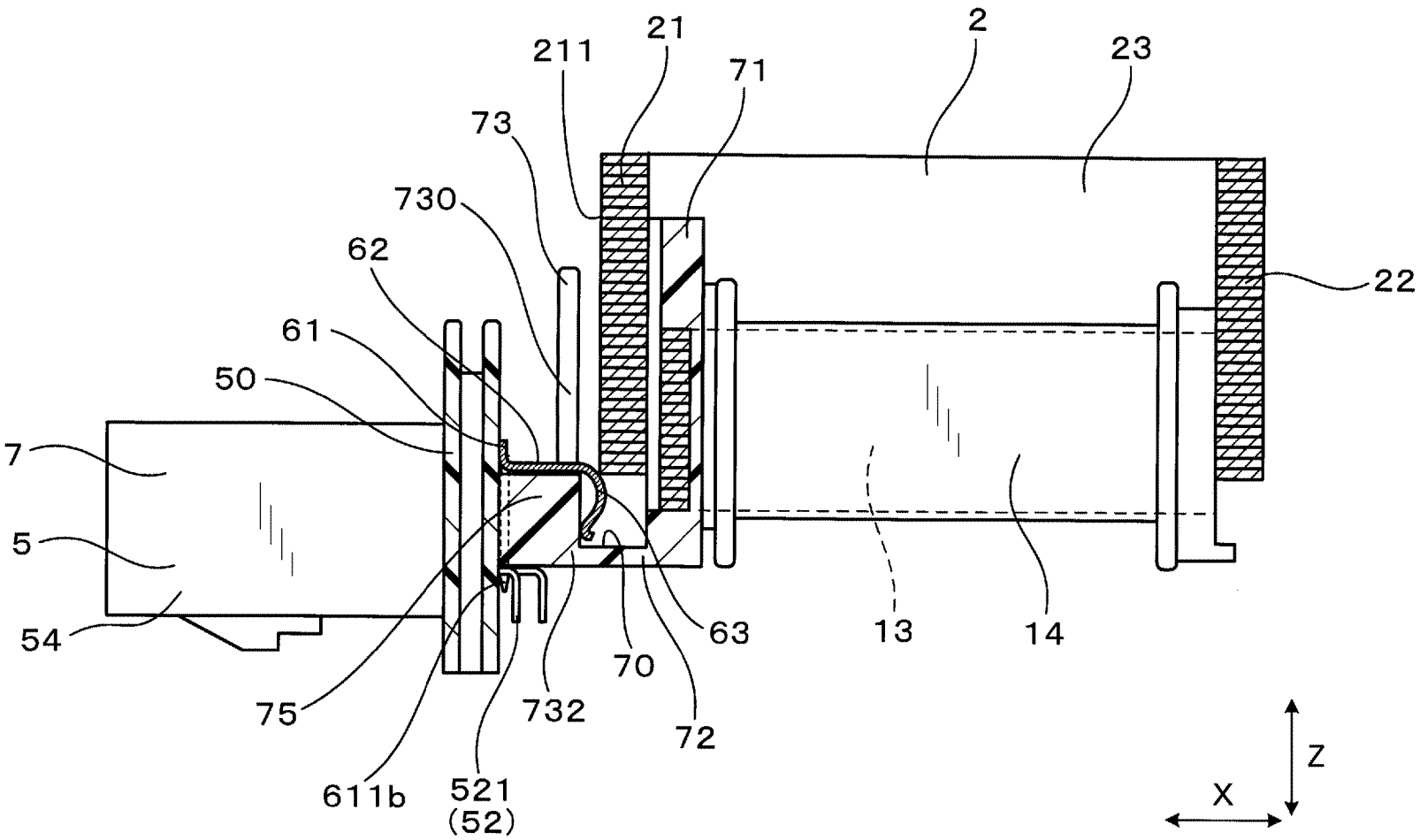
FIG. 8 is a drawing showing an appearance in which the outer circumferential core is being mounted on the connector module having the relay member mounted thereon according to the first embodiment.
Figure 9:
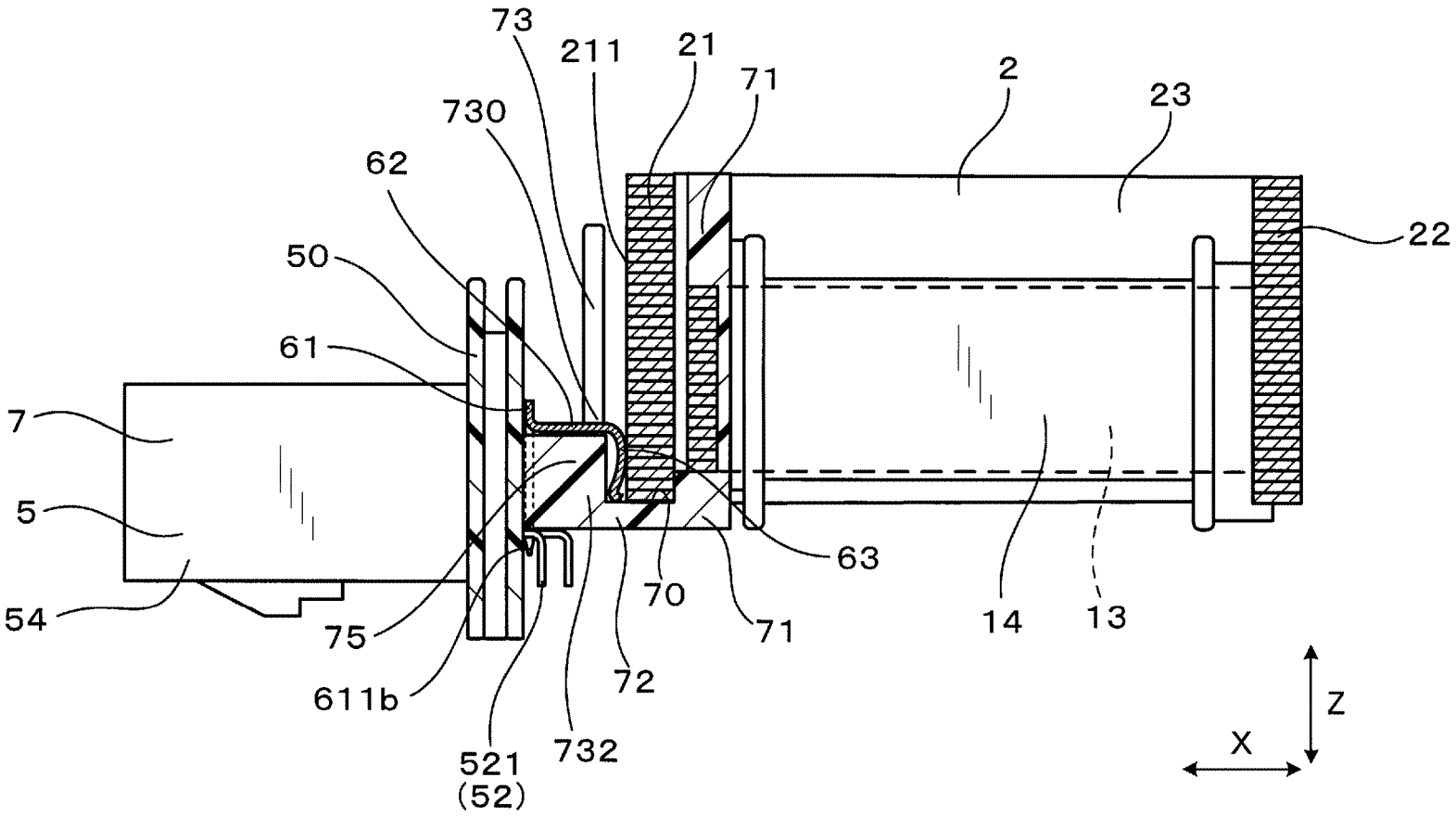
FIG. 9 is a drawing showing an appearance in which the relay member and the outer circumferential core are mounted on the connector module according to the first embodiment.

As shown FIGS. 8 and 9, the outer circumferential core 2 is mounted on the connector module 7 from the leading end of the connector module 7. At this time, the front-facing side portion 21 of the outer circumferential core 2 is fitted into the fitting recess 70 of the connector module 7. Subsequently, as shown in FIG. 8, the front-facing side portion 21 is brought into contact with the rear surface of the curved portion 63 of the relay member 6 and is brought into abutment with the front surface of the first wall portion 71. Then, as shown in FIG. 9, the outer circumferential core 2 is further pushed toward the trailing end against the connector module 7. Thus, the curved portion 63 is pressed in the coil axis direction X by the front-facing side portion 21 of the outer circumferential core 2. The curved portion 63 is elastically compressed in the coil axis direction X and is urged against the front-facing side portion 21. Furthermore, the rear surface of the front-facing side portion 21 is supported by the first wall portion 71, and thus the outer circumferential core 2 is positioned in the coil axis direction X with respect to the connector module 7. Moreover, the outer circumferential core 2 is pushed toward the trailing end against the connector module 7 until the trailing end surface of the outer circumferential core 2 abuts the leading end surface of the second wall portion 72 of the connector module 7. Thus, the outer circumferential core 2 is positioned in the vertical direction Z with respect to the connector module 7.

Accordingly, the relay member 6 and the outer circumferential core 2 can be mounted on the connector module 7.

Next, functions and effects of the present embodiment will be described.

In the ignition coil 1 for the internal combustion engine, the curved portion 63 is elastically deformed and is urged against the front surface 211 of the outer circumferential core 2. Therefore, the relay member 6 and the outer circumferential core 2 can be connected by bringing the curved portion 63 of the relay member 6 into contact with any part of the front surface 211 of the outer circumferential core 2. Accordingly, even when the positional relationship between the relay member 6 and the outer circumferential core 2 is not precisely determined, the relay member 6 and the outer circumferential core 2 can be connected. Thus, the manufacturing efficiency of the ignition coil 1 is improved.

Further, the relay member 6 has the base portion 61 in contact with the inner grounding terminal 521 and has the curved portion 63 elastically deformed in urged against the front surface 211 of the outer circumferential core 2. Therefore, the relay member 6 can be connected to the inner grounding terminal 521 and the outer circumferential core 2 without using the welding. Thus, the task of mounting these is facilitated, improving the manufacturing efficiency of the ignition coil 1.

Furthermore, the base portion 61 is provided along the rear surface of the engagement wall 50, and the standing portion 62 is provided further outward than the igniter 3 in the horizontal direction Y. Therefore, the igniter 3 and the relay member 6 can be prevented from interfering with each other when the igniter 3 is disposed on the front side of the center core 13. Thus, the manufacturing efficiency of the ignition coil 1 is improved.

Moreover, the plurality of inner grounding terminals 521 are arranged side by side in the horizontal direction Y, and a part of the base portion 61 is inserted and fitted between the inner grounding terminals 521 that are adjacent to each other. Therefore, upon connecting the relay member 6 and the inner grounding terminals 521, there is no need to weld these elements. Thus, the connection between the relay member 6 and the inner grounding terminals 521 is facilitated, resulting in further improvement to the manufacturing efficiency of the ignition coil 1.

Further, in the present embodiment, the outer circumferential core 2 is grounded (earthed) via the relay member 6 and the grounding terminal member 52, and therefore the outer circumferential core 2 has stable ground potential. Accordingly, occurrence of the voltage between the igniter 3 and the outer circumferential core 2 becoming high can be reduced. Thus, the igniter 3 can be disposed near the outer circumferential core 2. In this way, in the present embodiment, the reliability of the ignition coil 1 can be ensured, and the ignition coil can be downsized.

Furthermore, the primary spool 14 and the connector unit 5 are integrally formed to constitute the connector module 7. Thus, the number of components is reduced. Accordingly, the manufacturing efficiency of the ignition coil 1 is improved.

Moreover, the connector module 7 includes the supporting portion 732 which supports, from the front, the end of the curved portion 63 opposite the standing portion 62. When the end of the curved portion 63 is supported by the supporting portion 732 in this way, the end of the curved portion 63 is not a free end, but is a fixed end, and thus the curved portion 63 can be securely in urged against the front surface 211 of the front-facing side portion 21 of the outer circumferential core 2. Thus, the reliability of the connection between the outer circumferential core 2 and the relay member 6 improves.

Further, the connector module 7 includes the positioning portion 731 that positions the standing portion 62 from both ends in the horizontal direction Y. Thus, the curved portion 63 is pressed by the front-facing side portion 21 of the outer circumferential core 2, allowing the relay member 6 to be prevented from rotating. Accordingly, the manufacturing efficiency of the ignition coil 1 further improves.

Furthermore, the first base portion 611 includes the rectangular portion 611*a* and the insertion fitting portion 611*b* projecting from the rectangular portion 611*a* toward the trailing end. Thus, the strength of the base portion 61 is ensured at the rectangular portion 611*a*, and the insertion fitting portion 611*b* of the base portion 61 can be easily inserted and fitted between the inner grounding terminals 521.

As described above, according to the present embodiment, an ignition coil for an internal combustion engine which can improve manufacturing efficiency can be provided.

Second Embodiment

Figure 10:
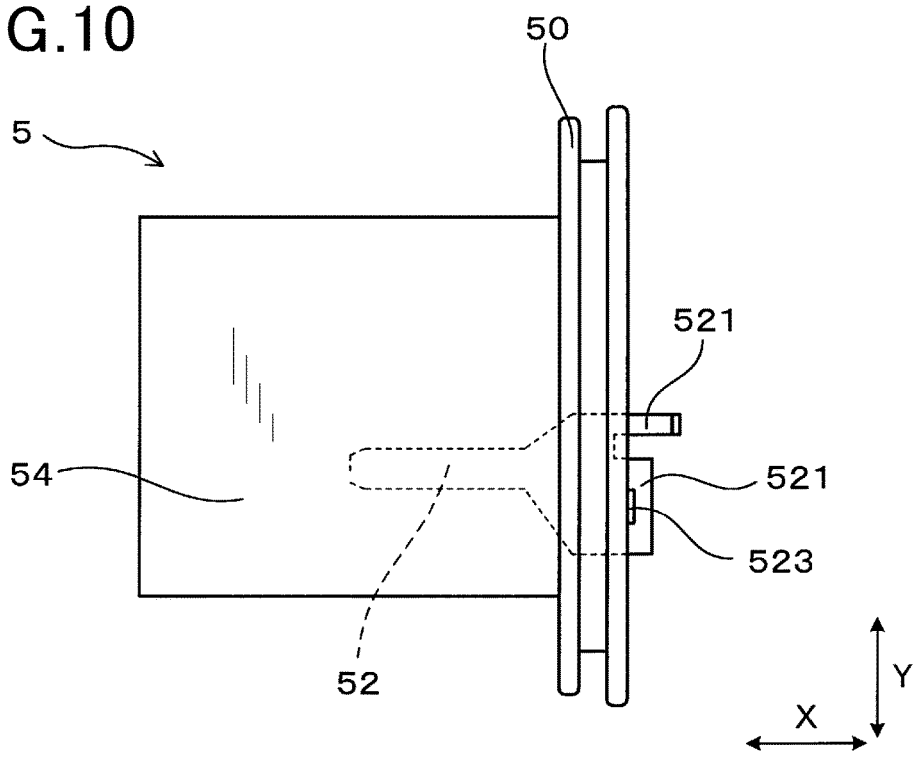
FIG. 10 is an illustration of a connector unit according to a second embodiment as seen from a leading end.
Figure 11:
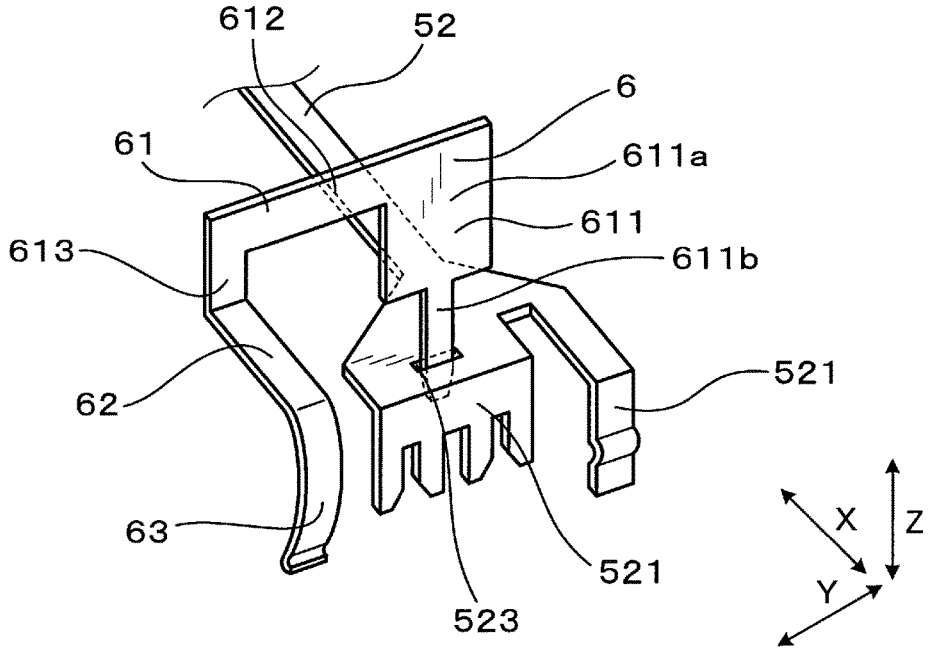
FIG. 11 is a perspective view of a grounding terminal member and a relay member according to the second embodiment.

In the present embodiment, as shown in FIGS. 10 and 11, an inner grounding terminal 521 has a through-hole 523 passing therethrough in the vertical direction Z, and a base portion 61 is inserted and fitted into the through-hole 523. In the present embodiment, two inner grounding terminals 521 are arranged side by side in the horizontal direction Y. Among the two inner grounding terminals 521, one inner grounding terminal 521 has the through-hole 523. The through-hole 523 is formed in a position contacting an engagement wall 50. An insertion fitting portion 611*b* of a relay member 6 is inserted and fitted into the through-hole 523.

The other details are the same as or similar to those in the first embodiment. Note that among reference signs used in the second embodiment and subsequent embodiments, reference signs that are the same as those used in the previously described embodiment represent structural elements that are the same as or similar to those in the previously described embodiment unless otherwise noted.

The present embodiment can produce functions and effects that are the same as or similar to those of the first embodiment.

Third Embodiment

Figure 12:
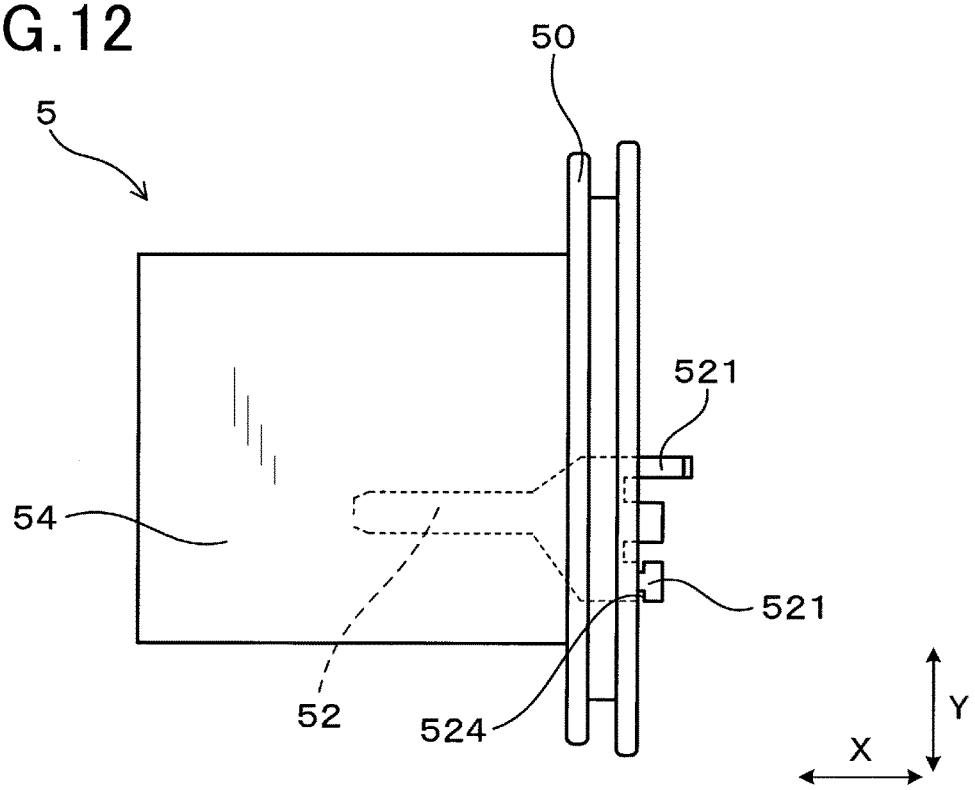
FIG. 12 is an illustration of a connector unit according to a third embodiment as seen from a leading end.
Figure 13:
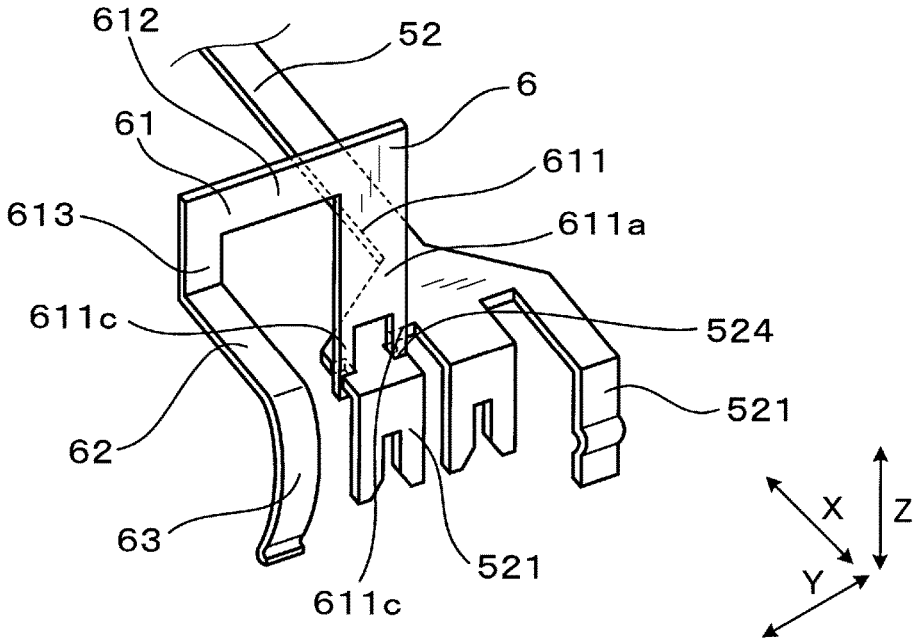
FIG. 13 is a perspective view of a grounding terminal member and a relay member according to the third embodiment.

The present embodiment is an example obtained by modifying a shape of the relay member 6 and a shape of the inner grounding terminal 521 according to the first embodiment, as shown in FIGS. 12 and 13. As shown in FIG. 13, a first base portion 611 in a base portion 61 of a relay member 6 includes a rectangular portion 611*a* and a pair of fitting portions 611*c* which project toward the trailing end from both ends in the horizontal direction Y of the rectangular portion 611*a* and are elongated in the vertical direction Z.

As shown in FIGS. 12 and 13, an inner grounding terminal 521 that contacts the relay member 6 has a pair of fitted recesses 524 having both ends in the horizontal direction Y indented inward in the horizontal direction Y. Fitted recesses 524 are formed in a position contacting an engagement wall 50. The pair of fitting portions 611*c* are fitted into the pair of fitted recesses 524. In other words, the base portion 61 is fitted to the inner grounding terminal 521 in such a way as to pinch the inner grounding terminal 521. Thus, the relay member 6 and a grounding terminal member 52 are electrically connected.

The other details are the same as or similar to those in the first embodiment, and the present embodiment has functions and effects that are the same as or similar to those of the first embodiment.

Fourth Embodiment

Figure 14:
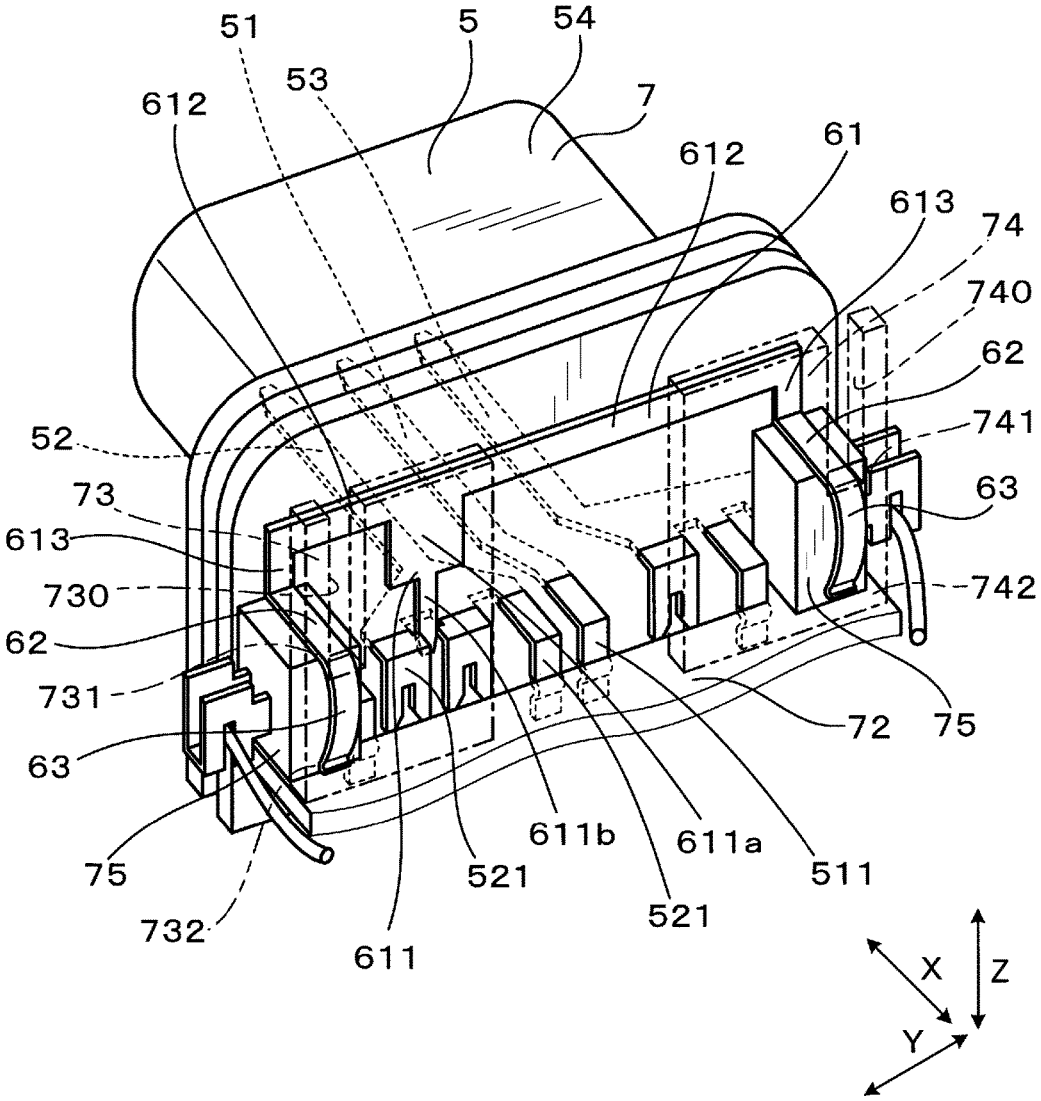
FIG. 14 is a partial enlarged perspective view of a connector module and a relay member according to a fourth embodiment.

In the present embodiment, as shown in FIG. 14, a relay member 6 includes a pair of standing portions 62 and a pair of curved portions 63. The pair of standing portions 62 are provided on both sides of an igniter 3 in the horizontal direction Y. The pair of curved portions 63 are each in urged against a front surface 211 of an outer circumferential core 2.

In the present embodiment, a fourth wall portion 74 also has a slit portion 740. One of the standing portions 62 is provided in a slit portion 730 of a third wall portion 73, and the other standing portion 62 is provided in the slit portion 740 of the fourth wall portion 74. In other words, in the present embodiment, both the third wall portion 73 and the fourth wall portion 74 include positioning portions 731 and 741, respectively.

The pair of standing portions 62 are placed on a pair of connecting portions 75. An end of the curved portion 63 extending from the standing portion 62 provided in the slit portion 740 of the fourth wall portion 74, opposite the standing portion 62, is in abutment with, and is supported by, a part of the fourth wall portion 74 that is on the trailing end of the slit portion 740. In other words, in the present embodiment, the third wall portion 73 and the fourth wall portion 74 include a supporting portion 732 and a supporting portion 742, respectively.

A base portion 61 connects ends of the pair of standing portions 62 opposite the curved portions 63 to each other. In the present embodiment, the base portion 61 includes two second base portions 612 and two third base portions 613. The pair of second base portions 612 and the pair of third base portions 613 are each formed on the opposite sides of the first base portion 611 in the horizontal direction Y The other details are the same as or similar to those in the first embodiment.

In the present embodiment, each of the pair of curved portions 63 is urged against the front surface 211 of the outer circumferential core 2, and therefore the reliability of the connection between the relay member 6 and the outer circumferential core 2 improves. Thus, the electrical connection between the outer circumferential core 2 and a grounding terminal member 52 can be ensured.

Aside from this, the present embodiment has functions and effects that are the same as or similar to those of the first embodiment.

Fifth Embodiment

Figure 15:
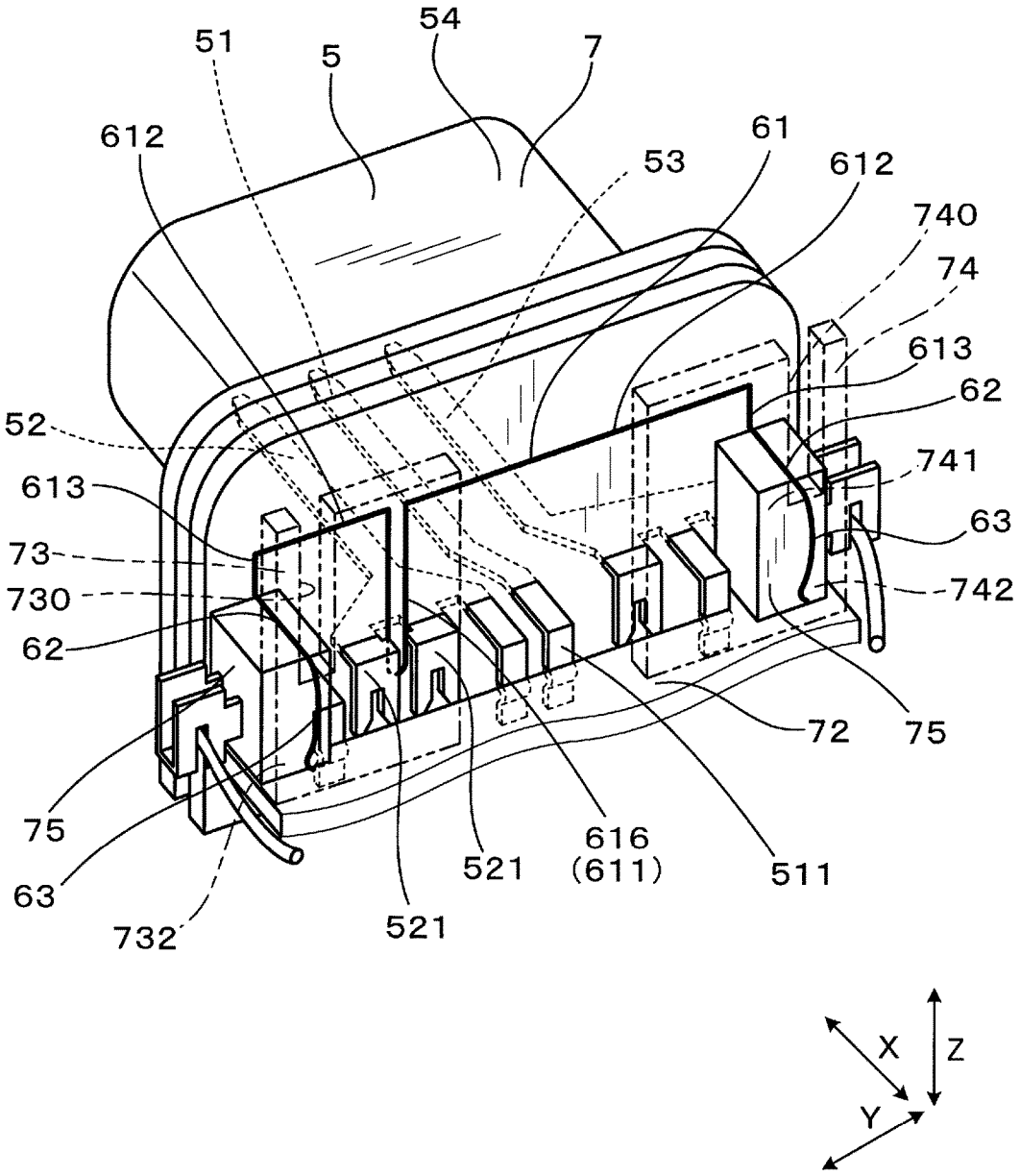
FIG. 15 is a partial enlarged perspective view of a connector module and a relay member according to a fifth embodiment.

As shown in FIG. 15, the present embodiment is a modification of the fourth embodiment in which the relay member 6 according to the fourth embodiment is formed of a wire member. In the present embodiment, a first base portion 611 of a base portion 61 between a pair of standing portions 62 in the horizontal direction Y is a U-shaped portion 616 protruding toward the trailing end. When a trailing end of the U-shaped portion 616 is fitted between inner grounding terminals 521 that are adjacent to each other, the relay member 6 and a grounding terminal member 52 are electrically connected.

The other details are the same as or similar to those in the fourth embodiment.

In the present embodiment, since the relay member 6 is formed of the wire member, an increase in material yield can be seen. Furthermore, also in the present embodiment, the base portion 61 is formed between the pair of standing portions 62 and the pair of curved portions 63 in the horizontal direction Y, as in the fourth embodiment. Therefore, even when the relay member 6 is formed of the wire member, the rotation of the relay member 6 due to the curved portion 63 being pressed by the outer circumferential core 2 toward the trailing end can be prevented.

Aside from this, the present embodiment has functions and effects that are the same as or similar to those of the fourth embodiment.

Note that the present invention is not limited to the embodiments described above and can be applied to various embodiments within the scope of the present invention. As an example, the fifth embodiment can be combined with first to third embodiments. Although the above embodiments describe the form in which a surface of the magnetic steel sheet forming the center core and the outer circumferential core is coated by the insulating material, this is not limited thereto; the center core and the outer circumferential core may be formed of a magnetic steel sheet the surface of which is not coated by the insulating material.

REFERENCE SIGNS LIST

1 Ignition coil for an internal combustion engine
2 Outer circumferential core
211 Front surface of an outer circumferential core
3 Igniter
5 Connector unit
52 Grounding terminal member
521 Inner grounding terminal
6 Relay member
61 Base portion
62 Standing portion
63 Curved portion

The invention claimed is:

1. An ignition coil for an internal combustion engine comprising:

a primary coil wound around a primary spool;

a secondary coil wound around a secondary spool provided on an outer circumference side of the primary coil;

a center core disposed on an inner circumference side of the primary coil and the secondary coil;

an outer circumferential core disposed on the outer circumference side of the primary coil and the secondary coil;

an igniter provided on a front side of the center core in a coil axis direction which is a direction of an axis about which the primary coil and the secondary coil are wound;

a case which houses the primary coil, the secondary coil, the center core, the outer circumferential core, and the igniter;

a connector unit mounted on a front end of the case and including at least a signal terminal member for transmitting a switching signal to the igniter and a grounding terminal member for grounding the igniter; and a relay member that electrically connects the outer circumferential core and the grounding terminal member, wherein the connector unit includes an engagement wall that is engaged with the case and faces the igniter from front of the igniter in the coil axis direction, the signal terminal member penetrates the engagement wall and includes an inner signal terminal projecting into the case, the grounding terminal member penetrates the engagement wall and includes an inner grounding terminal projecting into the case, the relay member includes a base portion provided along a rear surface of the engagement wall, a standing portion standing rearward of the base portion, and a curved portion that extends from a rear end of the standing portion in a vertical direction orthogonal to the coil axis direction and is curved to protrude rearward, the base portion is in contact with the inner grounding terminal at one end in the vertical direction, the standing portion is provided further outward than the igniter in a horizontal direction orthogonal to both the coil axis direction and the vertical direction, and the curved portion is elastically deformed and is in pressure-contact with a front surface of the outer circumferential core.

2. The ignition coil for the internal combustion engine according to claim 1, wherein a plurality of the inner grounding terminals are arranged side by side in the horizontal direction, and a part of the base portion is inserted and fitted between the inner grounding terminals that are adjacent to each other.

3. The ignition coil for the internal combustion engine according to claim 1, wherein the inner grounding terminal has a through-hole passing therethrough in the vertical direction, and the base portion is inserted and fitted into the through-hole.

4. The ignition coil for the internal combustion engine according to claim 1, wherein the primary spool and the connector unit are integrally formed to constitute a connector module.

5. The ignition coil for the internal combustion engine according to claim 4, wherein the connector module includes a supporting portion that supports, from front, an end of the curved portion opposite the standing portion.

6. The ignition coil for the internal combustion engine according to claim 4, wherein the connector module includes a positioning portion that positions the standing portion from both ends in the horizontal direction.

7. The ignition coil for the internal combustion engine according to claim 1, wherein the relay member includes a pair of the standing portions and a pair of the curved portions, the pair of standing portions are provided on both sides of the igniter in the horizontal direction, and each of the pair of curved portions is in pressure-contact with the front surface of the outer circumferential core.

8. The ignition coil for the internal combustion engine according to claim 1, wherein the relay member is formed of a wire member.

9. The ignition coil for the internal combustion engine according to claim 1, wherein the base portion includes: a first base portion formed along the vertical direction; a second base portion extending along the horizontal direction from a leading end of the first base portion which is on one side in the vertical direction; and a third base portion extending from an end of the second base portion opposite the first base portion toward a proximal end which is on a side opposite the leading end in the vertical direction, the first base portion includes: a rectangular portion in the form of a rectangle when viewed in the coil axis direction; and an insertion fitting portion projecting from the rectangular portion toward the proximal end, the standing portion projects from an end of the third base portion opposite the second base portion, and the curved portion extends toward the proximal end from an end of the standing portion opposite the base portion.

* * * * *